US006086394A

United States Patent [19]

Tung

[11] Patent Number: 6,086,394

[45] Date of Patent: Jul. 11, 2000

[54] CARD EJECTOR MECHANISM OF A CONNECTOR, HAVING AN ELASTIC MECHANISM PUSHING AN INSERTED CARD BY DEPRESSING A BUTTON MECHANISM

[75] Inventor: Shun-Chi Tung, Tu-Chen, Taiwan

[73] Assignee: Hon Hai Precision Ind. Co., Ltd., Taipei Hsien, Taiwan

[21] Appl. No.: 09/218,863

[22] Filed: Dec. 21, 1998

[30] Foreign Application Priority Data

May 14, 1998 [TW] Taiwan ..... 87207439

[51] Int. Cl.[7] ..... H01R 13/62

[52] U.S. Cl. ..... 439/159

[58] Field of Search ..... 439/159

[56] References Cited

U.S. PATENT DOCUMENTS 5,179,505 1/1993 Matsuo ..... 439/159
5,305,180 4/1994 Mitchell ..... 439/159
5,791,920 8/1998 Tomioka ..... 439/159
5,899,763 5/1999 Kajiura ..... 439/159

*Primary Examiner*—Lincoln Donovan
*Assistant Examiner*—Javaid Nasri

[57] ABSTRACT

An ejector mechanism for a connector comprises a receptacle defined in a top surface of a header of the connector and an elastic device received in the receptacle. An elastic ejection plate is adapted to force the elastic device to deform and store tension when an external card is manually inserted into the header of the connector in a first direction and exerts a force on the ejection plate along the first direction. A button device projects from the ejection plate. A retaining plate is fixed to the connector and defines a first hole and a second hole for respectively receiving the button device at different statuses. The button device is moved from the first hole to the second hole when the elastic ejection plate is pushed by the inserted card in the first direction. The button device receives a force from the elastic device and returns to the first hole when it is depressed downward below a retention region of the second hole.

7 Claims, 9 Drawing Sheets

CARD EJECTOR MECHANISM OF A CONNECTOR, HAVING AN ELASTIC MECHANISM PUSHING AN INSERTED CARD BY DEPRESSING A BUTTON MECHANISM

BACKGROUND OF THE INVENTION

1. Field of the Invention

The present invention relates to an ejector mechanism of a connector, and especially to an ejector mechanism for use in a PCMCIA connector.

2. The Prior Art

PCMCIA card connectors have become popular in portable computers. The card connectors are commonly configured with an ejector mechanism having a lever and a push bar for driving an ejecting plate to disconnect and eject IC cards therefrom.

A conventional ejector mechanism, as shown in FIG. 1, comprises a lever 10 having a fulcrum 18 formed at an intermediate portion thereof for pivotably fixing to a header portion 17 of a PCMCIA connector 19. The header portion 17 is fixed to a front end of a frame 14. Normally, an IC card 15 is inserted from a rear end of the frame 14 to engage with the header portion 17 of the connector 19. The lever 10 has a first end movably connected to a push bar 12 and driven thereby to pivot about the fulcrum 18. A handle 13 is formed at one end of the push bar 12. A second end of the lever 10 is connected to an ejection plate 11 which is activated by a driving force from the lever 10 when a force is exerted on the push bar 12. The lever 10 is shown in two sets of phantom lines to illustrate the movement thereof. The phantom line portions of the handle 13 and the IC card 15 also illustrate the respective movements thereof.

A drawback of this design is that a portion of the handle 13 extends beyond the rear end of the frame 14 thereby occupying excess space and potentially damaging the handle 13 due to an external force acting thereon. In addition, a predetermined force must be exerted on the handle 13 to withdraw the IC card 15 from the connector. Moreover, the lever and the push bar and the configuration thereof are complicated thereby increasing manufacturing costs.

Therefore, it is requisite to provide a new ejector mechanism which does not require a lever and a push bar whereby a card can be ejected therefrom with less force than the prior art.

SUMMARY OF THE INVENTION

The primary purpose of the present invention is to provide an ejector mechanism for a card connector which occupies a limited space and requires a limited operational force.

The second purpose of the present invention is to provide an ejector mechanism which utilizes elastic means for ejecting a card.

In accordance with one aspect of the present invention, an ejector mechanism for a connector comprises a receptacle and an elastic means received in the receptacle. An elastic ejection plate is adapted to force the elastic means to generate deformation and store tension therein when an external card is manually inserted into the connector in a first direction and exerts force on the ejection plate along the first direction. A button means projects from the ejection plate. A retaining plate is fixed on the connector and defines a first hole and a second hole for respectively receiving the button means in different time. The button means is moved from the first hole to the second hole when the card is inserted to the connector to push the elastic ejection plate in the first direction and the button means returns to the first hole when depressed downward to be under retention region of the second hole and receiving a force from the elastic means in an opposite direction to the first direction.

These and additional objectives, features, and advantages of the present invention will become apparent after reading the following detailed description of the preferred embodiments taken in conjunction with the appended drawing figures.

DETAILED DESCRIPTION OF THE PREFERRED EMBODIMENTS

Figure 3:
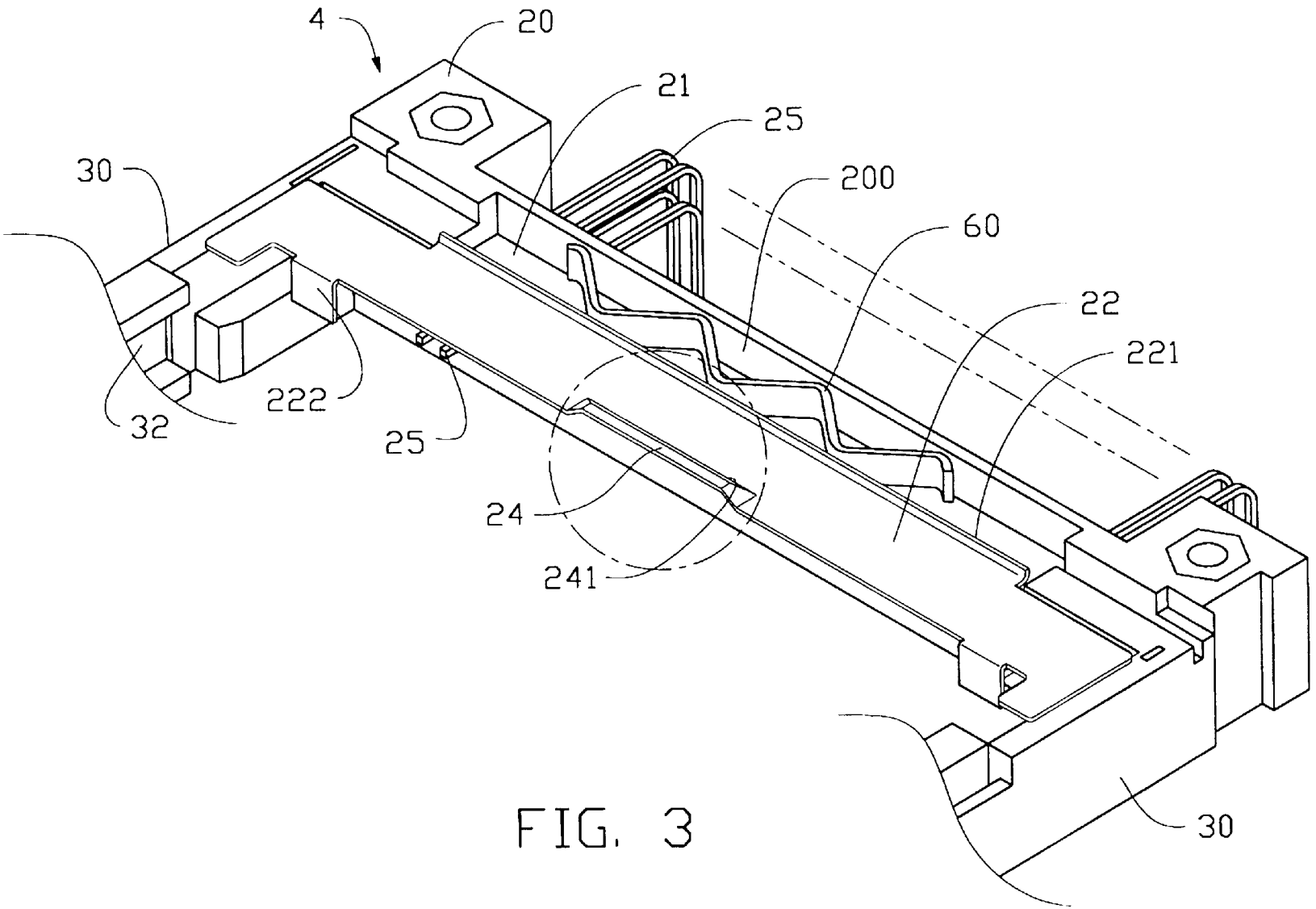
FIG. 3 is similar to FIG. 2 wherein a retaining plate is removed therefrom to clearly show elastic means positioned at a top portion of the header.

If Referring to FIG. 3, an ejector mechanism for a connector 4 in accordance with the present invention comprises a receptacle 200 defined in a top of a header 20. The header 20 retains contacts 25 therein for electrically engaging with an IC card (not shown). The contacts 25 partially extend out of the header 20 and are formed as right angled contacts. Elastic means 60 positioned in the receptacle 200, is shaped like a wave and an upper portion thereof extends beyond an upper surface of the header 20. The elastic means 60 is made from a metal strip by stamping and bending.

A pair of guiding arms 30 are connected to opposite ends of the header 20. Each guiding arm 30 defines an inner channel 32 exposed toward each other for cooperating to receive an IC card. An elastic ejection plate 22 is positioned on the header 20 and comprises a curved wall 221 projecting upward from a front edge thereof and two ejection tabs 222 extending downward from a rear edge thereof. A block 24 projects from a middle portion of the rear edge of the ejection plate 22 and has a tapered face 241 facing the curved wall 221 of the ejection plate 22.

Figure 1:
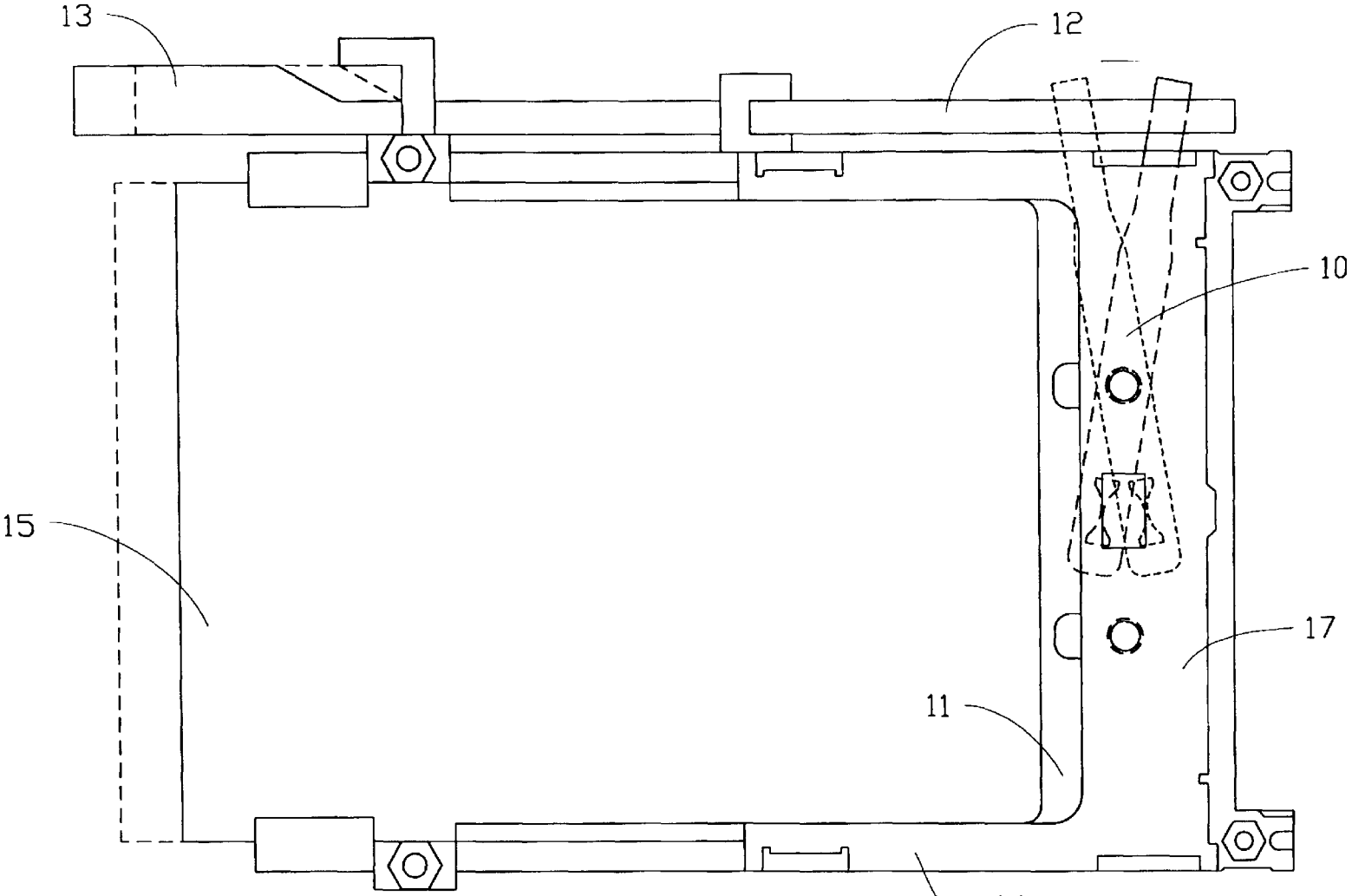
FIG. 1 (PRIOR ART)
FIG. 1 is a schematic view of a conventional PCMCIA card connector.
Figure 2:
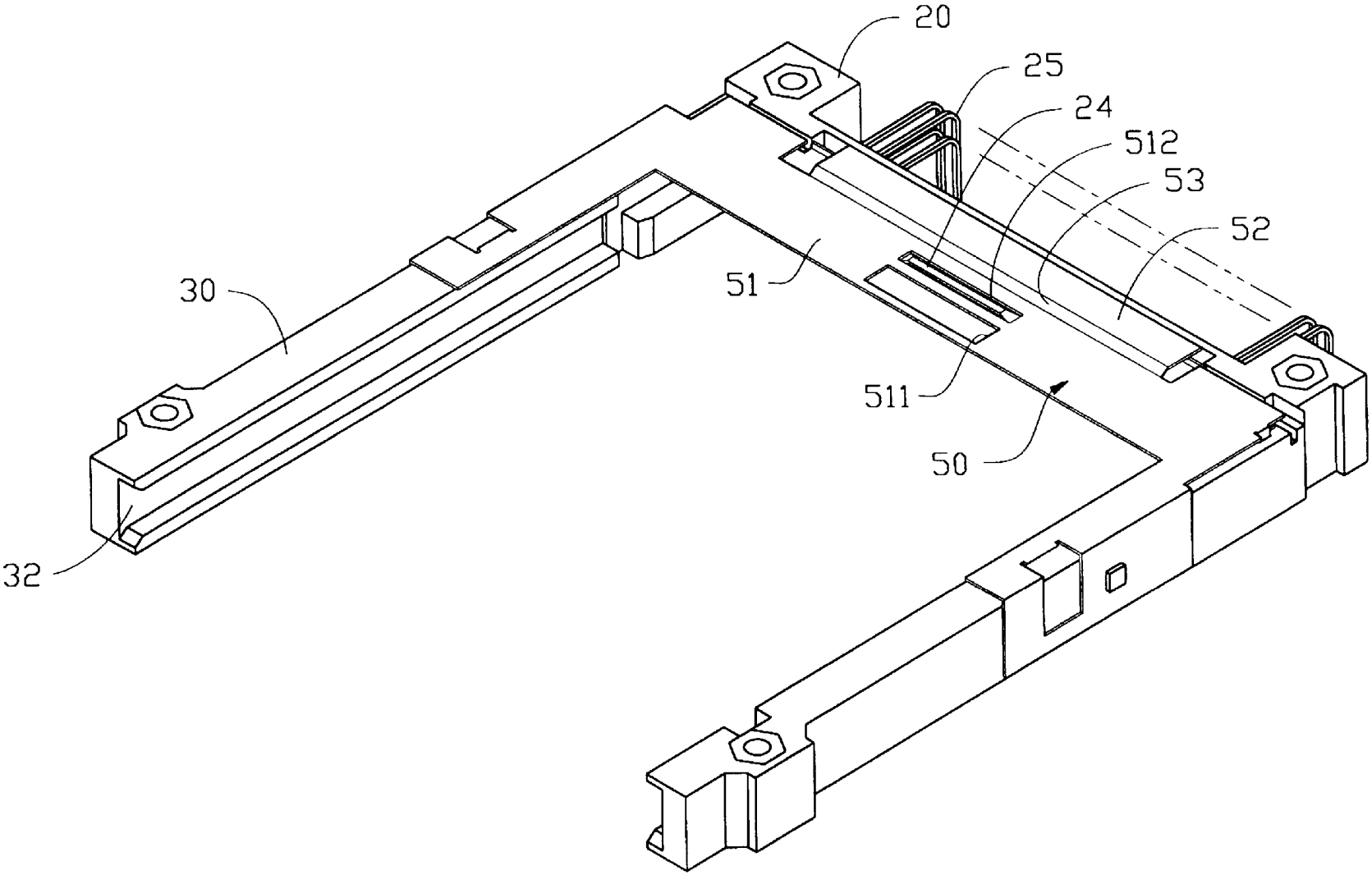
FIG. 2 is a perspective view of a PCMCIA connector in accordance with the present invention.

Referring to FIG. 2, a substantially U-shaped retaining plate 50 is fixed to the header 20 and the guiding arms 30 and covers the ejection plate 22 while allowing the ejection plate 22 to move thereunder when the ejection plate 22 receives a predetermined force. The retaining plate 50 comprises a first flat portion 51, an inclined portion 53 extending upward from one edge of the first flat portion 51, and a second flat portion 52 extending horizontally from one edge of the inclined portion 53. The second flat portion 52 exists at a higher level than the first flat portion 51 for preventing contact with the elastic means 60. The retaining plate 50 defines a first hole 511 and a second hole 512 for receiving the block 24 at different statuses.

Figure 5:
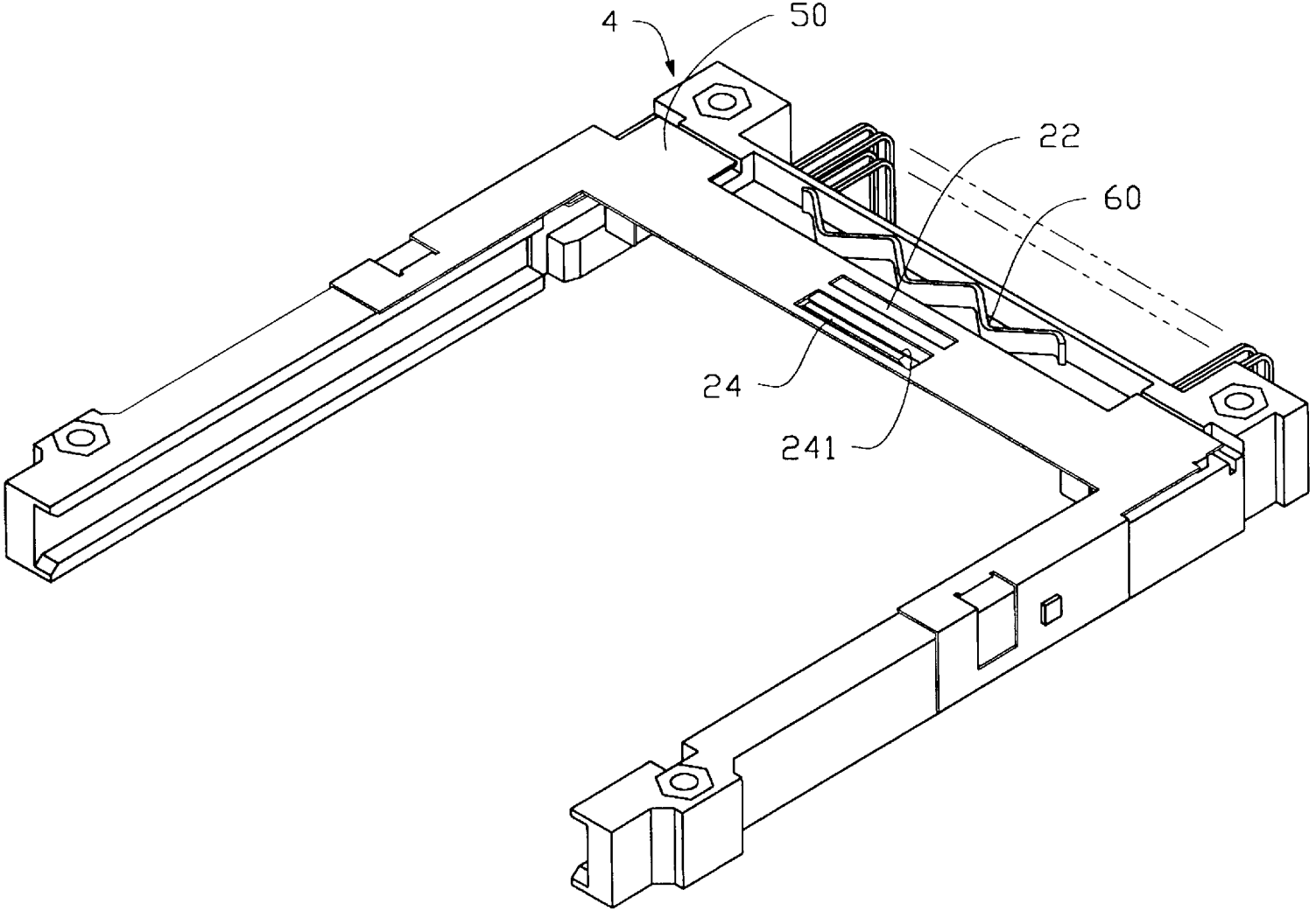
FIG. 5 is a schematic view with a portion of the retaining plate being omitted for showing the elastic means at an uncompressed status.

Referring to FIG. 5, the block 24 is normally retained in the first hole 511 when the elastic means 60 is at an uncompressed status. During this status, a card is not received in the connector 4.

Figure 6:
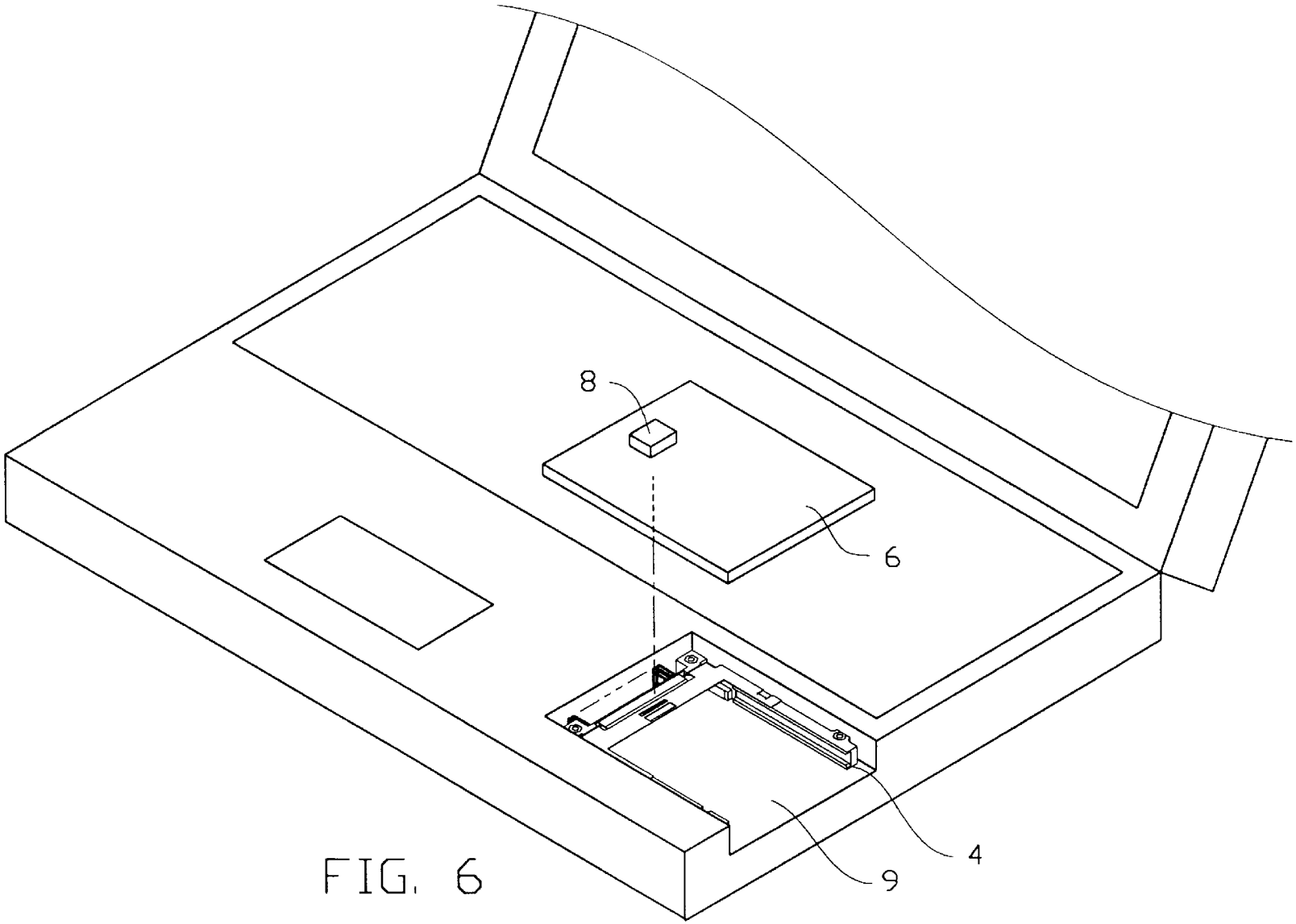
FIG. 6 is a partially assembled view showing the ejector mechanism and the connector installed in a notebook computer.
Figure 7:
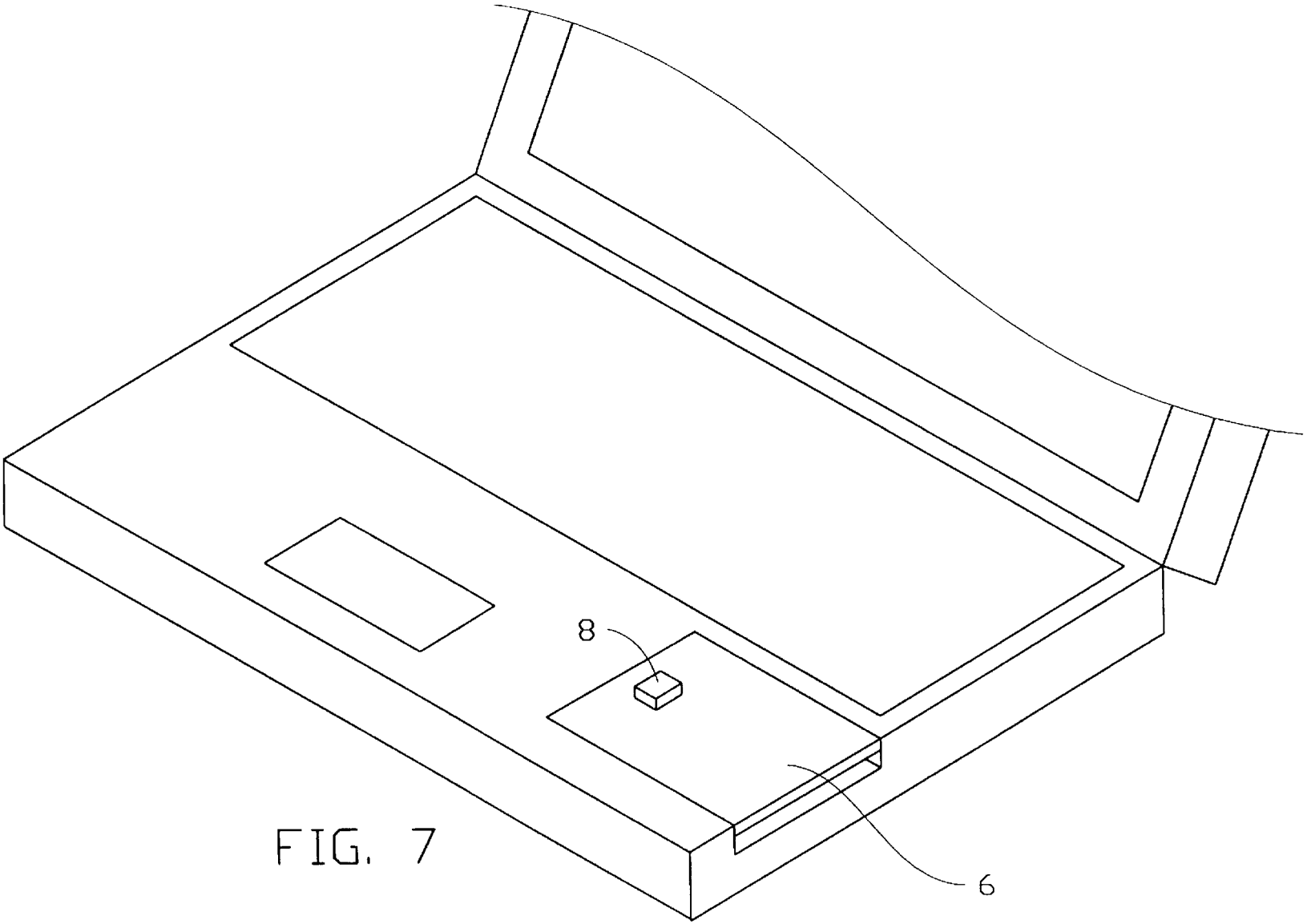
FIG. 7 is a fully assembled view of FIG. 6.

Referring to FIGS. 6 and 7, the connector 4 is positioned in a recess 9 of a notebook computer and covered by a covering member 6 which is engaged with the computer. A push button 8 is installed in the covering member 6 substantially in alignment with the block 24 when the block 24 protrudes from the second hole 512. The push button 8 depresses the block 24 when it is depressed; therefore, the block 24 also behaves like a button.

Figure 4:
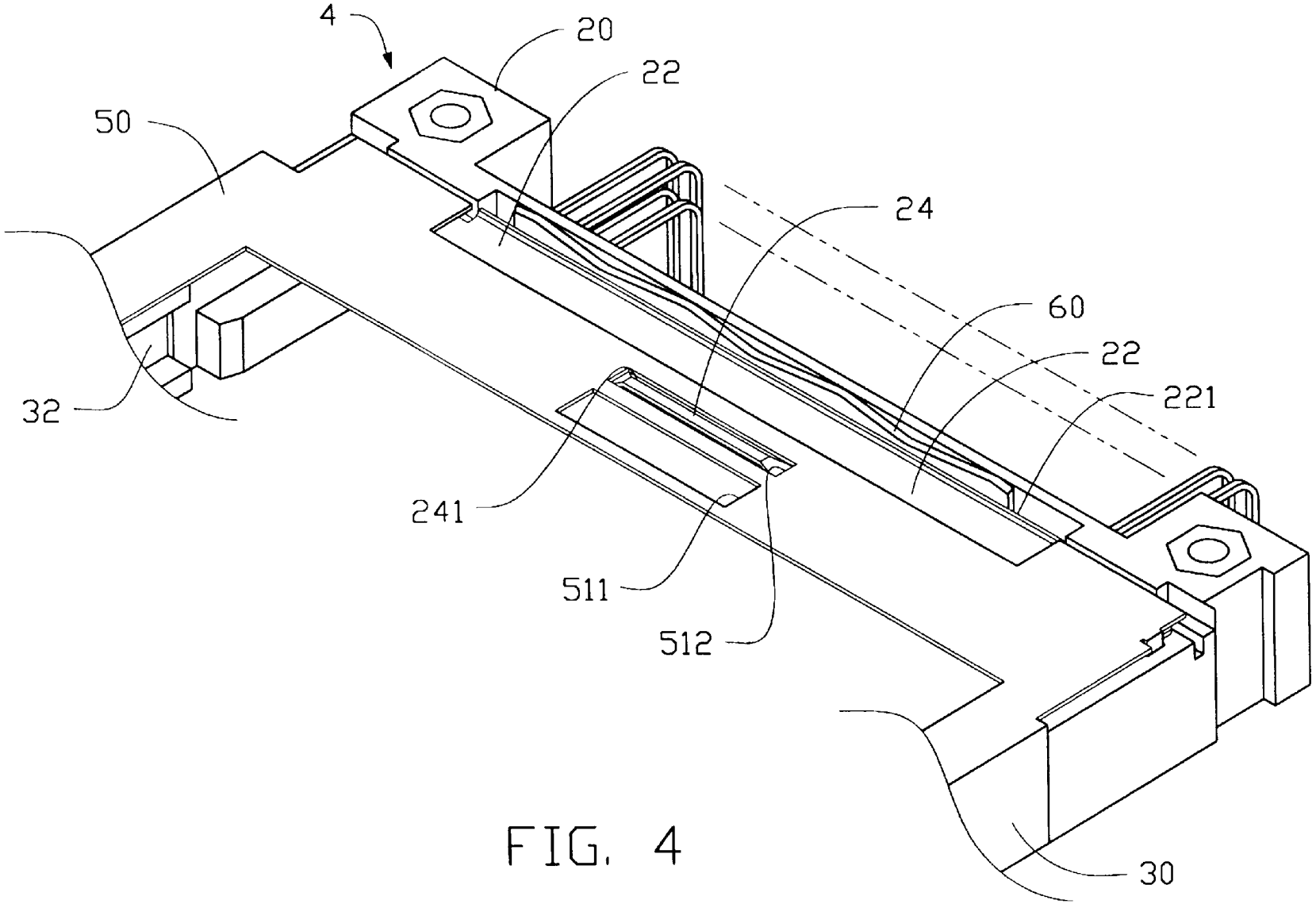
FIG. 4 is an operational view with a portion of the retaining plate being omitted for showing the elastic means being compressed and deformed by an ejection plate.

Referring to FIG. 4, when a card is inserted into the connector 4 from the inner channels 32 of the guiding arms 30, the ejection tabs 222 of the ejection plate 22 are pushed thereby, and the ejection plate 22 together with the block 24 is pushed forward to compress the elastic means 60. Specifically, the block 24 disengages from the first hole 511 when the ejection plate 22 is pushed by the inserted card and the ejection plate 22 meets with the tapered face 241 of the block 24 thereby moving the block 24 from the first hole 511 to the second hole 512. The ejection plate 22 experiences a temporary deformation when the block 24 slides under the retaining plate 50. The ejection plate 22 resumes its original shape when the block 24 is received in the second hole 512. The elastic means 60 deforms and stores tension therein due to a compression force from the curved wall 221 of the ejection plate 22 acting thereon. The elastic means 60 is retained in the compressed status since the block 24 is retained in the second hole 512.

The block 24 moves from the second hole 512 to the first hole 511 when the push button 8 (FIGS. 6 and 7) is depressed to lower the block 24 below the retention region of the second hole 512 thereby causing the elastic means 60 to release its tension and push the ejection plate 22 back. Meanwhile, the block 24 slides under the retaining plate 50 and the ejection plate 50 experiences a temporary deformation. When the block 24 is received in the first hole 511, the elastic means 60 totally recovers to the uncompressed status and the ejection plate 50 also resumes its original shape.

Figure 8:
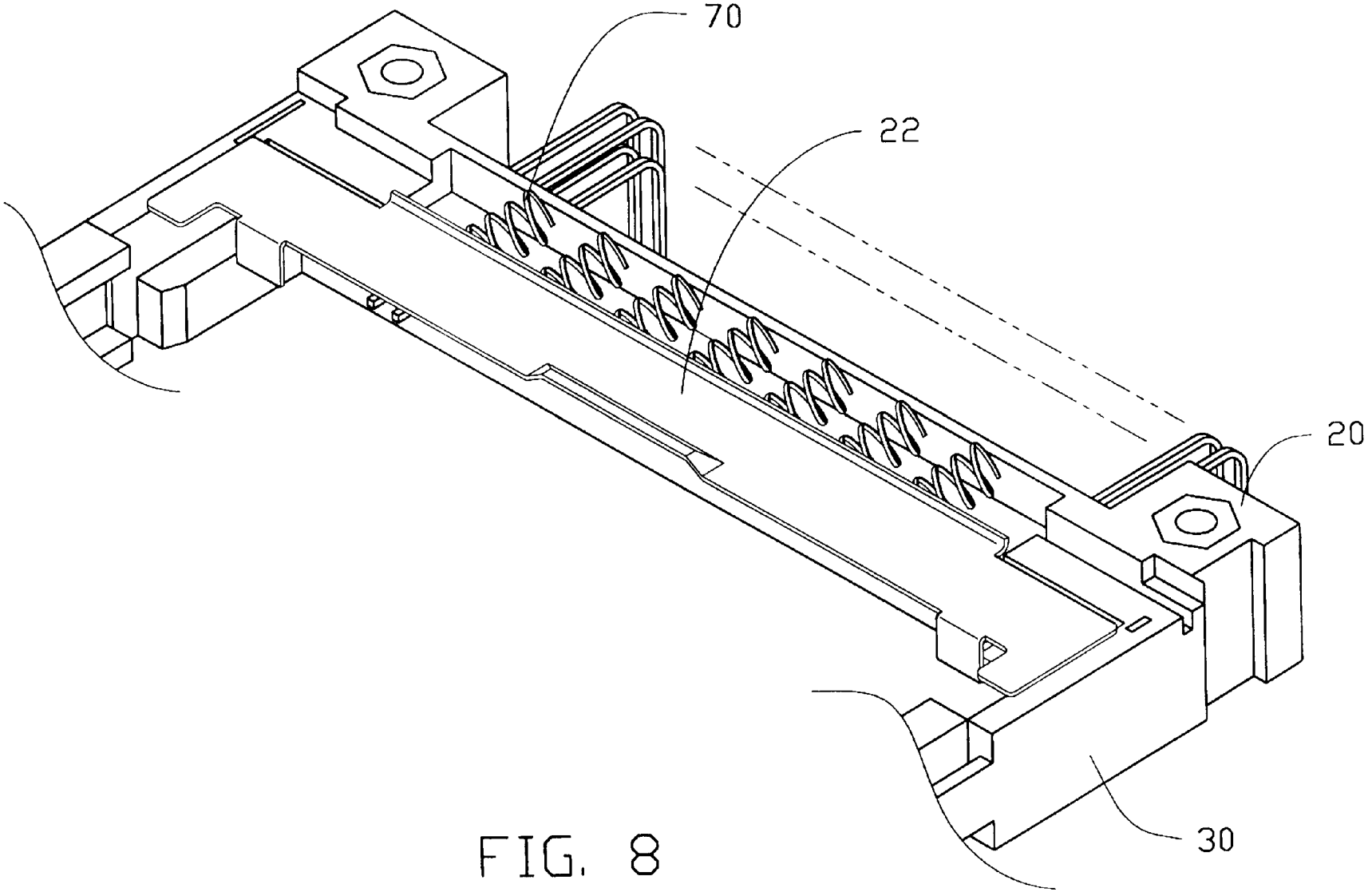
FIG. 8 illustrates a second type of elastic means installed in a receptacle of the connector.
Figure 9:
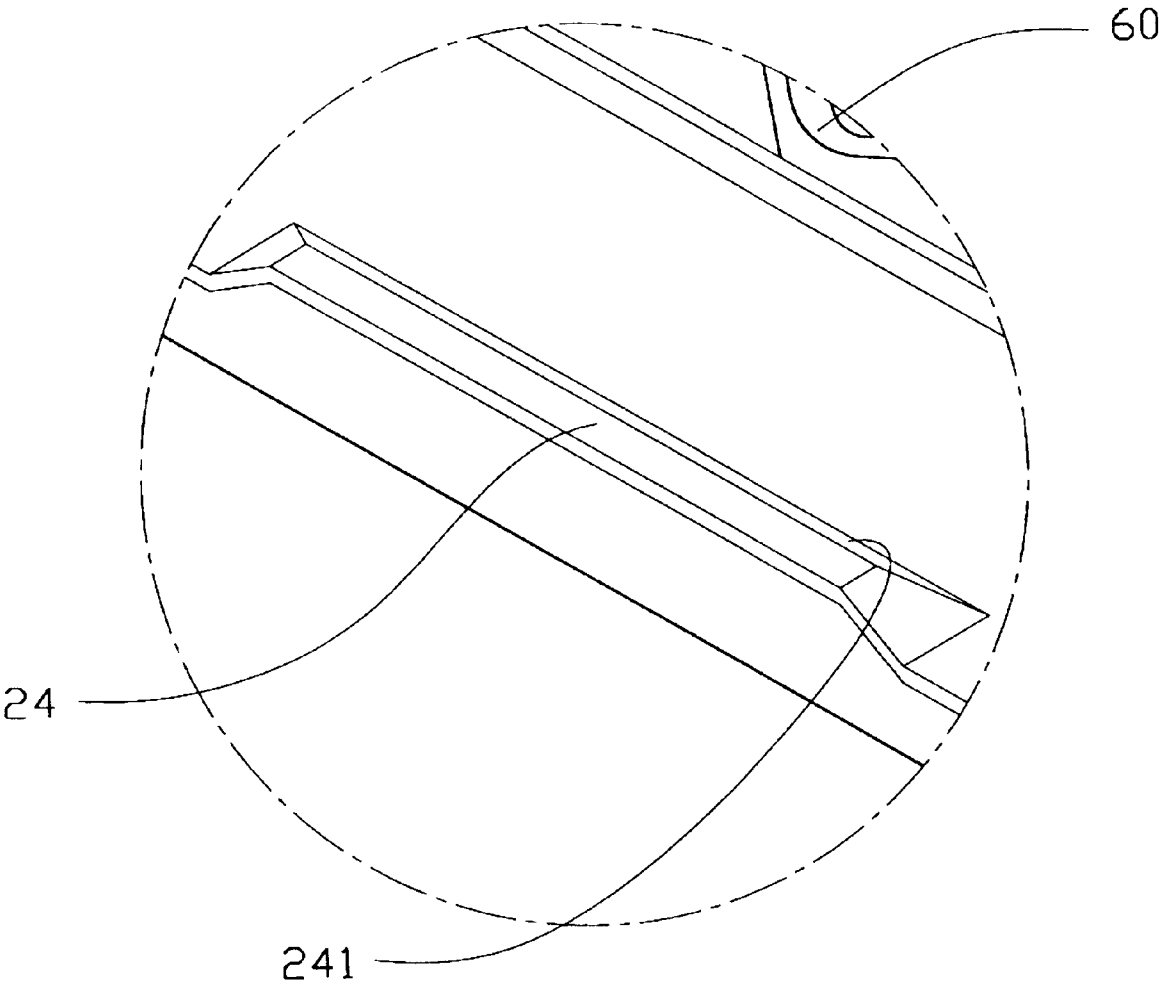
FIG. 9 is an enlarged view of a portion of FIG. 3 as indicated by a circle in a phantom line between lines 5 and 6.

Referring to FIG. 8, a plurality of springs 70 may replace the elastic means 60. The springs 70 are compressed along their axial directions when the card is inserted into the connector 4 and recover to their uncompressed status when the push button 8 is depressed.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

What is claimed is:

1. An ejector mechanism for a connector comprising:

a receptacle;

elastic means received in the receptacle;

an elastic ejection plate adapted to force the elastic means to deform and store tension when an external card is manually inserted into the connector in a first direction and exerts a force on the ejection plate along the first direction;

button means projecting from the ejection plate; and a retaining plate fixed to the connector and defining a first hole and a second hole for respectively receiving the button means at different statuses;

whereby when a card is inserted into the connector the elastic ejection plate is pushed in the first direction and the button means moves from the first hole to the second hole, and when the button means is depressed downward below a retention region of the second hole the button means receives a force from the elastic means and returns to the first hole.

2. The ejector mechanism as claimed in claim 1, wherein the receptacle is defined in a surface of a header of the connector which retains a plurality of contacts therein.

3. The ejector mechanism as claimed in claim 1, wherein the elastic means is a metal plate having a wave shape.

4. The ejector mechanism as claimed in claim 1, wherein the elastic means comprises at least one spring having an axial orientation parallel to the first direction.

5. The ejector mechanism as claimed in claim 1, wherein the first hole and the second hole are substantially in alignment with each other along a line of movement of the button means and the second hole is located closer to the elastic means than the first hole.

6. The ejector mechanism as claimed in claim 5, wherein the button means is a block having a tapered face confronting the elastic means, whereby when the button means is received in the first hole, a force in the first direction from the insertion of the card moves the button means from the first hole under the retaining plate until the button means is received in the second hole.

7. A connector comprising:

a header extending in a lengthwise direction with a plurality of contacts disposed along said lengthwise direction;

elastic means disposed along said lengthwise direction for deformably storing forces;

an ejection plate directly engaging the elastic means along said lengthwise direction with multiple contact points, said ejection plate evenly forcing the elastic means to deform and store tension when an external card is manually inserted into the connector and moves the ejection plate in a first direction;

means for retaining the ejection plate in a locking position when the elastic means is in a deformed status and for releasing the ejection plate from the locking position when the means is subject to a depressing force acting thereon so that the elastic means changes from the deformed status to an un-deformed status, and the ejection plate with the card is moved by a recovery force of the deformed elastic means in a second direction opposite to the first direction.

* * * * *